US010736394B2

(12) United States Patent
Akins et al.

(10) Patent No.: US 10,736,394 B2
(45) Date of Patent: Aug. 11, 2020

(54) HAIR CURLING DEVICE

(71) Applicants: Kristine E. Akins, Portland, OR (US); Ciera D. Akins, Portland, OR (US)

(72) Inventors: Kristine E. Akins, Portland, OR (US); Ciera D. Akins, Portland, OR (US)

(73) Assignee: CHARLIECURLS, INC., Portland, OR (US)

( * ) Notice: Subject to any disclaimer, the term of this patent is extended or adjusted under 35 U.S.C. 154(b) by 600 days.

(21) Appl. No.: 15/169,496

(22) Filed: May 31, 2016

(65) Prior Publication Data

US 2016/0345705 A1 Dec. 1, 2016

Related U.S. Application Data

(60) Provisional application No. 62/168,471, filed on May 29, 2015.

(51) Int. Cl.
*A45D 8/36* (2006.01)

(52) U.S. Cl.
CPC ..... *A45D 8/36* (2013.01)

(58) Field of Classification Search
CPC ... A45D 8/36; A45D 8/34; A45D 8/00; A45D 2008/004; A45D 2/00; A45D 6/00; A45D 7/00; A42B 1/02; H05B 3/58; H05B 3/345; H05B 3/342; H05B 3/347; F16L 53/38
USPC ..... 132/246
See application file for complete search history.

(56) References Cited

U.S. PATENT DOCUMENTS

| | | | | | |
|---|---|---|---|---|---|
| 347,177 | A * | 8/1886 | Schach | A45D 2/18 | 132/246 |
| 1,512,490 | A | 10/1924 | Scheanblum et al. | | |
| 1,916,943 | A | 2/1932 | Beadle | | |
| 1,908,970 | A * | 5/1933 | Frankel | A45D 2/18 | 132/246 |
| 2,066,709 | A * | 1/1937 | Adams | A45D 2/18 | 132/246 |
| 5,499,638 | A | 3/1996 | Ripley | | |
| 5,553,631 | A * | 9/1996 | Schach | A45D 8/00 | 132/210 |
| 5,621,921 | A * | 4/1997 | Outland | A42B 1/02 | 2/171 |
| 5,655,224 | A * | 8/1997 | Sears | A42C 5/00 | 132/273 |
| 5,664,589 | A * | 9/1997 | Black | A45D 2/20 | 132/246 |
| 5,694,955 | A * | 12/1997 | Grooms | A45D 2/125 | 132/212 |

(Continued)

*Primary Examiner* — Yogesh P Patel
*Assistant Examiner* — Jennifer F Gill
(74) *Attorney, Agent, or Firm* — Klarquist Sparkman, LLP

(57) ABSTRACT

Hair curling devices comprise a length of multi-stranded solid copper wire having ring crimp terminals secured to opposing ends. A fabric tube is situated about the length of multi-stranded copper wire and has first and second end portions that define corresponding fabric holes. The fabric tube is secured to the ring crimp terminals and prior to attachment, is longer that the wire/ring crimp terminal assembly so that the fabric tube is gathered about the multi-stranded copper wire. Hair bundles captured by the hair curling device form hair curls after a suitable exposure period. In some examples, flexible members other than copper wire are used, and the fabric tube and the wire/ring crimp terminal assembly can be secured to form a straight section or to form a loop.

7 Claims, 8 Drawing Sheets

(56) References Cited

U.S. PATENT DOCUMENTS

| | | | | |
|---|---|---|---|---|
| 6,189,543 | B1 * | 2/2001 | Sonstegard | A45D 8/00 132/246 |
| 6,397,854 | B1 * | 6/2002 | Bailey | A44C 5/0053 132/200 |
| 6,401,726 | B1 * | 6/2002 | Sonstegard | A45D 2/40 132/246 |
| 7,331,353 | B2 * | 2/2008 | Harvie | A45D 8/36 132/273 |
| 7,337,786 | B2 * | 3/2008 | Sonstegard | A45D 8/12 132/273 |
| 8,757,176 | B2 | 6/2014 | Harvie | |
| 2006/0150997 | A1 * | 7/2006 | Stephens | A45D 8/34 132/273 |
| 2012/0125360 | A1 * | 5/2012 | Hill | A45D 8/36 132/275 |
| 2013/0042885 | A1 | 2/2013 | Pilan | |
| 2013/0291886 | A1 * | 11/2013 | Davis | A45D 8/36 132/275 |

* cited by examiner

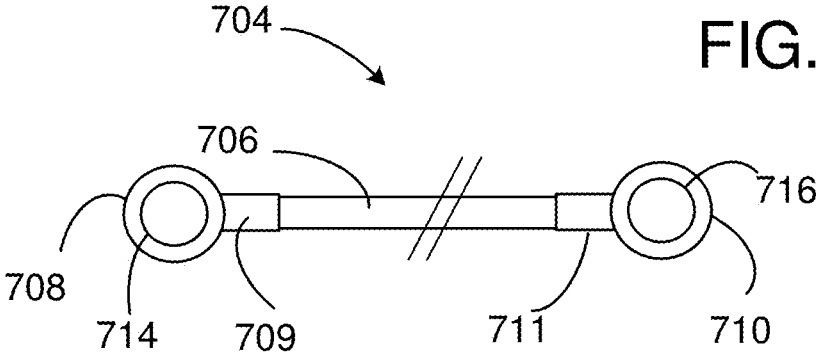
FIG. 7A
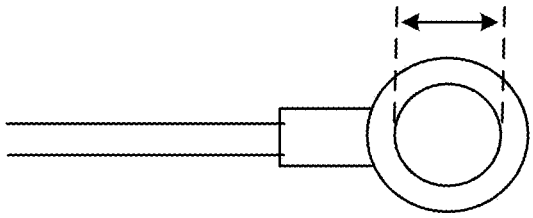
FIG. 7B
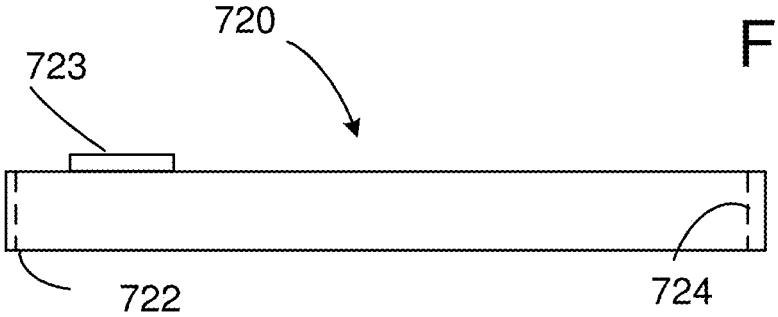
FIG. 7C
FIG. 7D
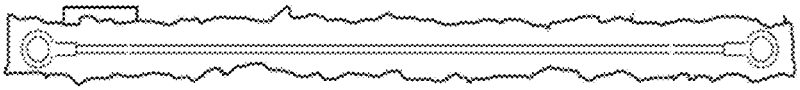

HAIR CURLING DEVICE

CROSS REFERENCE TO RELATED APPLICATION

This application claims the benefit of U.S. Provisional Application No. 62/168,471, filed May 29, 2015, which is incorporated herein by reference.

FIELD

The disclosure pertains to hair curling devices.

BACKGROUND

Many common hair curling products involve the use of heat or chemicals or multiple pieces with clips and pins involved, so that their use takes a lot of time and is limited. Most hair curlers involve multiple, individual pieces that are secured in the hair with clips or pins and are uncomfortable to wear yet still require heat to curl. Conventional hair styling devices such as cloth covered elastic bands can be used to retain hair in a braid or a ponytail or to hold hair away from a user's face, but such devices are fashion devices for styling hair and provide limited curling ability, and the inevitable pull on a hair bundle can be irritating to the wearer. Metallic or plastic clips can also retain hair, but are not used for curling the hair. Some representative approaches are disclosed in Ripley, U.S. Pat. No. 5,499,638, Harvie, U.S. Pat. No. 8,757,176, Beadle, U.S. Pat. No. 1,916,943, Scheanblum et al., U.S. Pat. No. 1,512,490, and Pilan, U.S. Patent Application Publication 2013/0042885, all of which are incorporated herein by reference. In one example disclosed in Bailey, U.S. Pat. No. 6,397,854, a bendable fabric-covered rod-like device is described for use as a hair holder such as for a ponytail or a headband. However, while such a device can be used as a hair curling rod, its primary purpose is a fashion accessory to decorate the hair. Its applicability to hair curling is limited because while Bailey's aluminum flexible center will hold a ponytail, or secure the hair away from the face, it is not designed to hold the weight of all of the hair rolled around the device on the head for long enough to supply significant curling without additional clips and will not securely hold hair while sleeping overnight. Devices specifically designed for putting in the hair to curl it and then removing from the hair to produce the desired style of curls and waves that are quick, simple, inexpensive, and comfortable remain needed.

SUMMARY

Hair curling devices comprising an elongated flexible core that will maintain its shape under the weight of a full head of hair when bent and a fabric cover enclosing the elongated flexible core and secured to the elongated flexible core at two opposite end portions of the elongated flexible core. The fabric cover has a length that is greater than the separation of the first and second end locations so that the fabric cover is gathered when secured to the elongated flexible core so that the hair is better secured within the gathers of the fabric when rolled. In some examples, the elongated flexible core includes at least one substantial wire, and the fabric cover is secured to the wire so as to enclose the end portions of the elongated flexible core. In other examples, the elongated flexible core includes a plurality of wires, and a length of fabric defining the fabric cover that is at least ⅓ or ¼ longer than a length of the elongated flexible member. In further embodiments, a length of the fabric defining the fabric cover is between 75 cm and 125 cm and a length of the elongated flexible core is between 50 cm and 100 cm. In some examples, end portions of the elongated flexible core and the fabric cover are secured at a common location so as to form a loop, typically with a fastener such as a snap or rivet. In some embodiments, respective end portions of the elongated flexible core are secured to end portions of the fabric cover with respective fasteners.

In some alternatives, the elongated flexible core includes at least one wire, or a plurality of wires such as the preferred solid copper wires, which have the quality of holding heavy hair with its own strength. In other examples, a ring terminal is situated at an end of the wires or plurality of solid wires so as to secure the wires to the fabric cover.

Methods of making a hair curling device comprise providing a wire assembly that includes a plurality of solid wires within a plastic jacket, the solid wires secured at opposing ends to respective rings. The wire assembly is encased in a fabric cover by securing respective end portions of the fabric cover to the rings so that the fabric cover is gathered. In some cases, the wire assembly is encased in the fabric cover by situating the wire assembly in a fabric tube that is at least ⅓ to ¼ longer than the wire assembly, and securing the fabric tube to the rings of the wire assembly with rivets or snaps. In one example, the plurality of solid wires comprises a wire cable having three individually jacketed 18 gauge solid copper wires within a plastic jacket.

Hair curling devices comprise a length of jacketed multi-stranded copper wire comprising three solid 18 gauge copper wires having first and second ring crimp terminals secured to opposing ends. A fabric tube is situated about the length of multi-stranded copper wire, and has first and second end portions that define corresponding fabric holes, wherein the fabric tube contains the length of multi-stranded copper wire and the first and second ring crimp terminals. At least a first rivet extends through at least one of the fabric holes in the first and second end portions of the fabric tube and at least one of the first and second ring crimp terminals so as to secure the fabric tube to the length of multi-stranded copper wire. In some examples, a second rivet is provided and the first and second rivets extend through first and second end portions of the fabric at respective fabric holes and the first and second ring crimp terminals, respectively so as to secure the fabric tube to the length of multi-stranded copper wire. In still other examples, the first rivet extends through first and second end portions of the fabric at respective fabric holes and the first and second ring crimp terminals, respectively, so as to secure the fabric tube to the length of multi-stranded copper wire to form a loop.

The foregoing and other objects, features, and advantages will become more apparent from the following detailed description, which proceeds with reference to the accompanying figures.

BRIEF DESCRIPTION OF THE DRAWINGS

FIGS. 7A-7D illustrate components of a representative hair curling device drawn with approximately scaled proportions.

DETAILED DESCRIPTION

Disclosed herein are hair curling devices and associated methods that are described with reference to several representative examples. The disclosed examples are for convenient illustration and it will be appreciated that these arrangements can be modified. The devices and methods generally permit simple, convenient, and inexpensive hair curling without the need for harsh chemicals, heat, pins, clips, or multiple, large, cumbersome, or complex devices. A hair curling device as disclosed herein is typically a one-piece device with no clips or pins required to maintain it in the hair and can be inserted into hair in less than one minute. Conventional hair curling devices have multiple pieces and take over 20 minutes to install in the hair, requiring additional pins and clips. Because the disclosed hair curling devices require no heat, no electricity, no chemicals, no pins and weigh less than two ounces, such devices are easily packable for travel and are convenient to use in short allotted time frames between other activities.

Figure 1A:
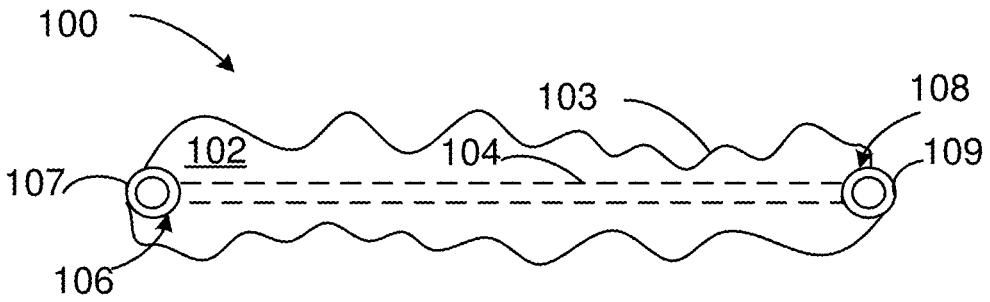
FIGS. 1A-1C illustrate a representative hair curling device.

Referring to FIG. 1, a hair curling device 100 includes a flexible core 104 that is situated within a cover 102, typically by sewing the cover 102 so as to contain the flexible core 104. As shown in FIG. 1, the cover 102 is generally secured to ends 106, 108 of the flexible core 104 with fasteners 107, 109, such as rivets, screws, snaps, staples, pins, or other fasteners. In other examples, the cover 102 and the flexible core 104 are secured with an adhesive or with a wrapping of string or wire or tape. The cover 102 can be made of fabric, leather, plastic, or other material, or a combination of such materials and is generally longer than the flexible core 104 so that as attached to the flexible core 104, multiple gathers, such as representative gather 103, are formed. The flexible core 104 is typically elongated, having a length dimension that is between 100 cm and 500 cm, and typically between about 50 cm and 110 cm. Length dimensions are generally selected to be somewhat larger that a perimeter associated with an average head but smaller or larger dimensions can be convenient in some applications. The flexible core 104 generally has much smaller dimensions in directions perpendicular to a length dimension. In some cases, the flexible core 104 is formed with one or more wires such as copper wires or one or more flexible metallic strips. For use in hair curling, the flexible core 104 permits securing the hair curling device 100 to a user's hair while being sufficiently stiff so as to form or curl hair as desired, even when left in place for extended time periods, ranging from less than an hour to a few hours to overnight. In addition, the flexible core 104 is formed of a material that can be subjected to repeated bending and twisting so that the hair curling device 100 can be used a great many times.

Figure 1B:
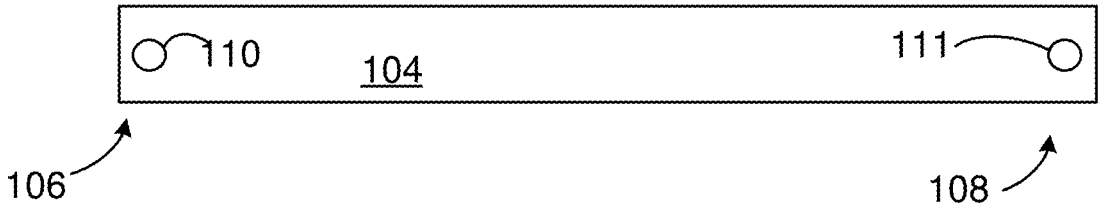
Figure 1C:
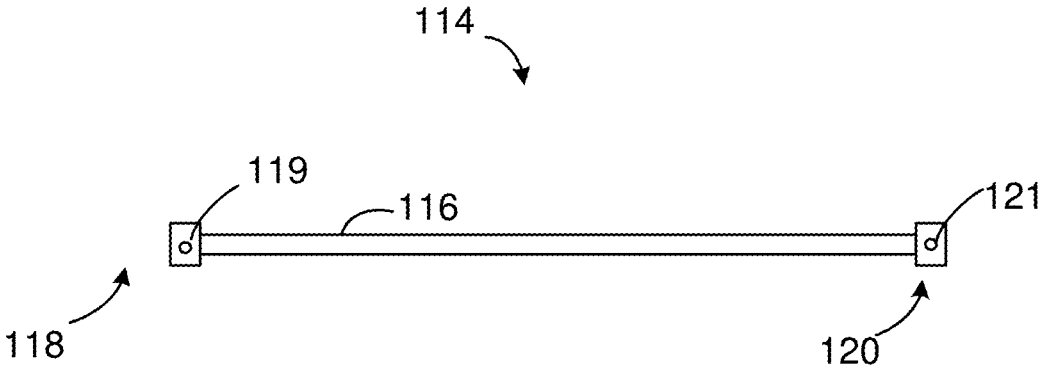

FIG. 1B illustrates a representative construction of the flexible core 104, showing holes 110, 111 situated at respective ends 106, 108 so as to permit insertion of rivets or other fasteners to be used in securing the flexible core 104 to the fabric cover 102. FIG. 1C illustrates an alternative flexible core 114 that includes an elongated plate or slab or one or more wires 116 having end portions 118, 120 that are provided with holes 119, 121 for use in securing to a fabric cover.

Figures 2A, 2B, 2C:
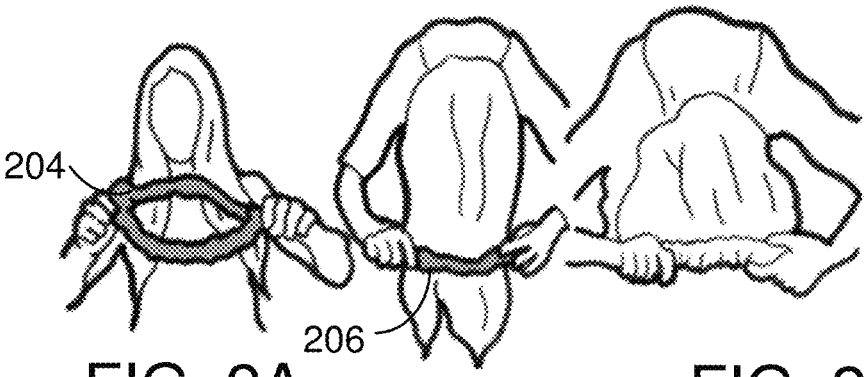
FIGS. 2A-2E illustrate a method of use of a hair curling device.
Figure 2D:
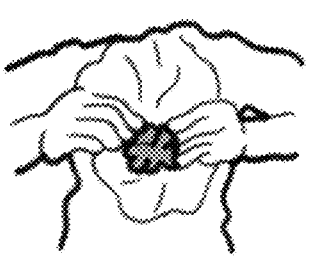
Figure 2E:
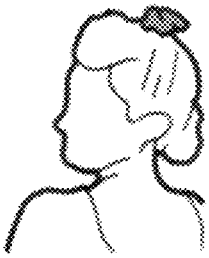
Figure 3:
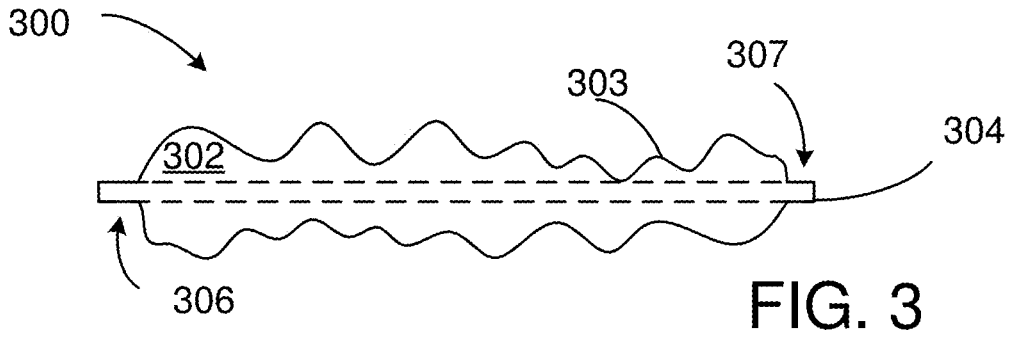
FIG. 3 illustrates a representative hair curling device in which a flexible member extends out of a fabric cover.

FIGS. 2A-2E illustrate a representative method of using a hair curling device as described above for curling. As shown in FIG. 2A a hair curling device 204 is formed into a loop. A hair portion 206 is then placed within the loop as shown in FIG. 2B. Ends of the loop can be pulled to collapse the loop onto the hair portion 206, and the hair portion 206 rolled as constrained by the loop as shown in FIG. 2C. When rolling is completed, the ends of the loop are secured together as shown in FIG. 2D, and the curled hair within the loop is left as shown in FIG. 2E for a suitable time period, depending on a desired curling effect or hair type such as straight, curly, thick, or thin. In addition, hair portions can be rolled into a tighter or looser roll, wherein looser rolls lead to wavier, softer curls. Curling results also depend on hair type, but suitable curling or waving can be obtained in time periods as short as less than an hour, but better results with heavier or straighter hair are typically obtained with longer time periods, such as overnight. Because such a curling device is simple to apply and portable, it can be conveniently used in many situations, such as during a workout, while getting ready to go out, or while driving to locations where looking good is important. Spritzing hair with water and then rolling can enhance results Referring to FIG. 3, in another example, a hair curling device 300 includes a fabric tube 302 that is situated to partially encase a flexible member 304. A length of the fabric tube 302 is selected so that as fixed to the flexible member 304, the fabric is gathered, forming gathered regions such as representative gather region 303, so as to sufficiently engage a hair bundle and keep the hair from falling out easily. As shown in FIG. 3, the fabric tube 302 is fixed to the flexible member 304 near respective end portions 306, 307, so that the flexible member 304 extends outside the fabric tube 302. Ends of the fabric tube 302 can be fixed to the flexible member 304 at end portions 306, 307 with an adhesive, or otherwise secured.

Figure 4:
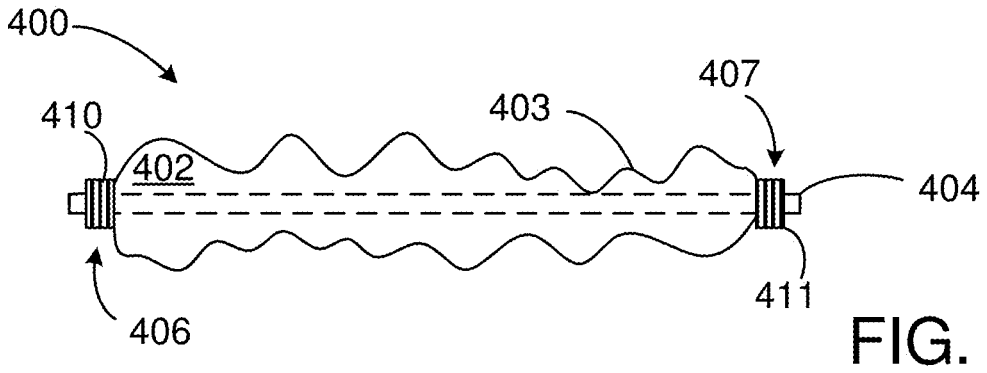
FIG. 4 illustrates another representative hair curling device.
Figure 5:
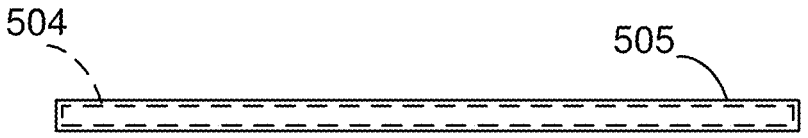
FIG. 5 illustrates a flexible member for a hair curling device that includes a coating or covering.

A further example is shown in FIG. 4. A hair curling device 400 includes a flexible member 404 that is partially encased in a fabric sleeve 402 but has end portions 406, 407 that extend beyond the fabric sleeve 402. In the example of FIG. 4, the fabric sleeve 402 has gathered portions 403 so as to better capture hair bundles for curling. The fabric sleeve 402 is secured to the flexible member 404 with string or wire wrappings 410, 411, or tape. Referring to FIG. 5, in embodiments in which a flexible member 504 extends beyond a fabric casing, an outer cover 505 of fabric, plastic, or other material that is more comfortable to the skin than, for example, metal, can be applied to the flexible member 504, at least at protruding end portions of the flexible member 504.

Figure 6:
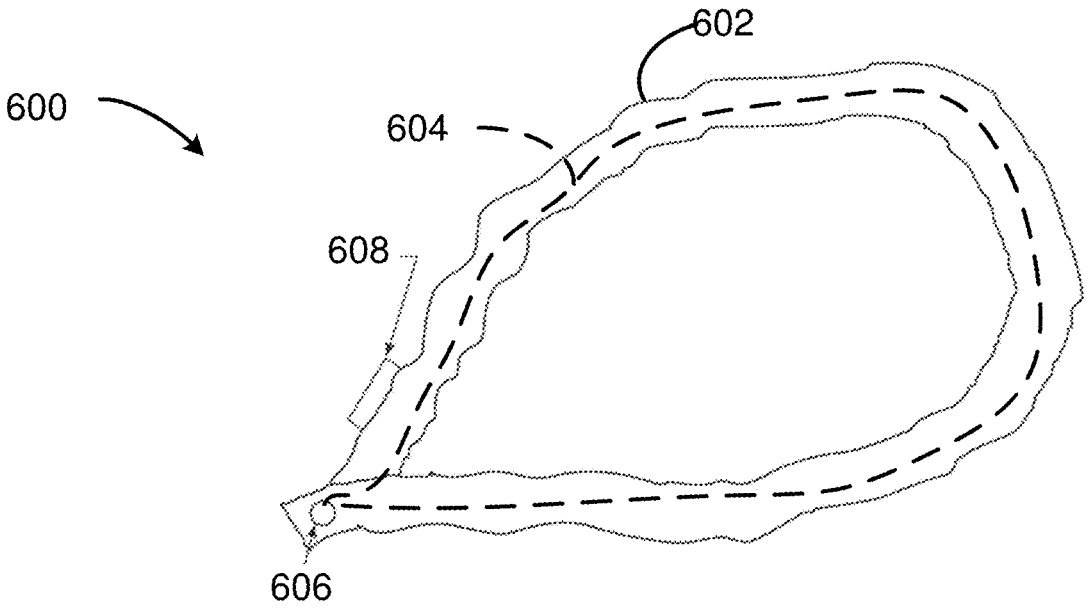
FIG. 6 illustrates a hair curling device that forms a loop.

FIG. 6 shows a hair curling device 600 that is formed as a loop, so that a user does not need to form a loop for curling. A fabric casing 602 substantially surrounds a flexible member 604. A single rivet 606 or other fastener secures ends of both the flexible member 604 and the fabric casing 602. If desired, a label 608 can be fixed to the fabric casing 602.

Components used to form a specific example of a hair curling device are shown in FIGS. 7A-7D. A flexible member 704 comprises a cable 706, such as a 28 inch length (~71 cm) of 18-3 bell wire, i.e., three individually jacketed 18 gauge solid copper bell wires situated within a common insulating cover. Ring terminals 708, 710 include respective crimp portions 709, 711 that receive the cable 706 so that the ring terminals can be crimped to the cable 706. The ring terminals 708, 710 also define respective through holes 714, 716 that have inner diameters so as to accommodate a rivet or other fastener so as to secure a fabric sleeve to the ring terminals 708, 710. In one example, the inner diameters of the hole are the same, and are about ½ inch or 13 mm. In some cases, the crimp portions 709, 711 are coated or covered with a soft material to keep the wire from breaking at the point where the metal crimps to the flexible core. An enlarged view of an end portion with a ring terminal is shown in FIG. 7B. With a 28 inch length of cable, overall length is about 30 inches.

Figure 7E:
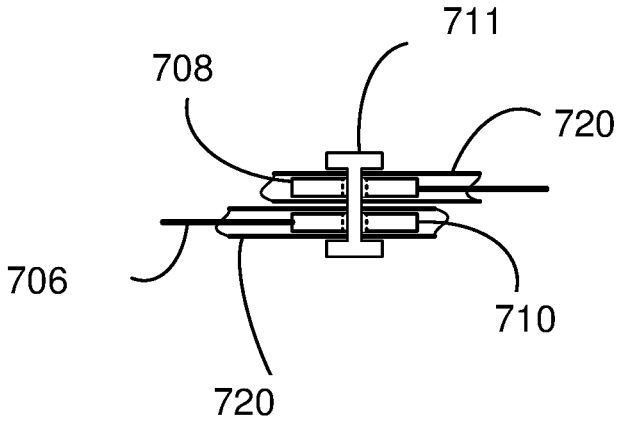
FIG. 7E is a sectional view illustrating ring terminals securing a fabric tube with a rivet.
Figure 8:
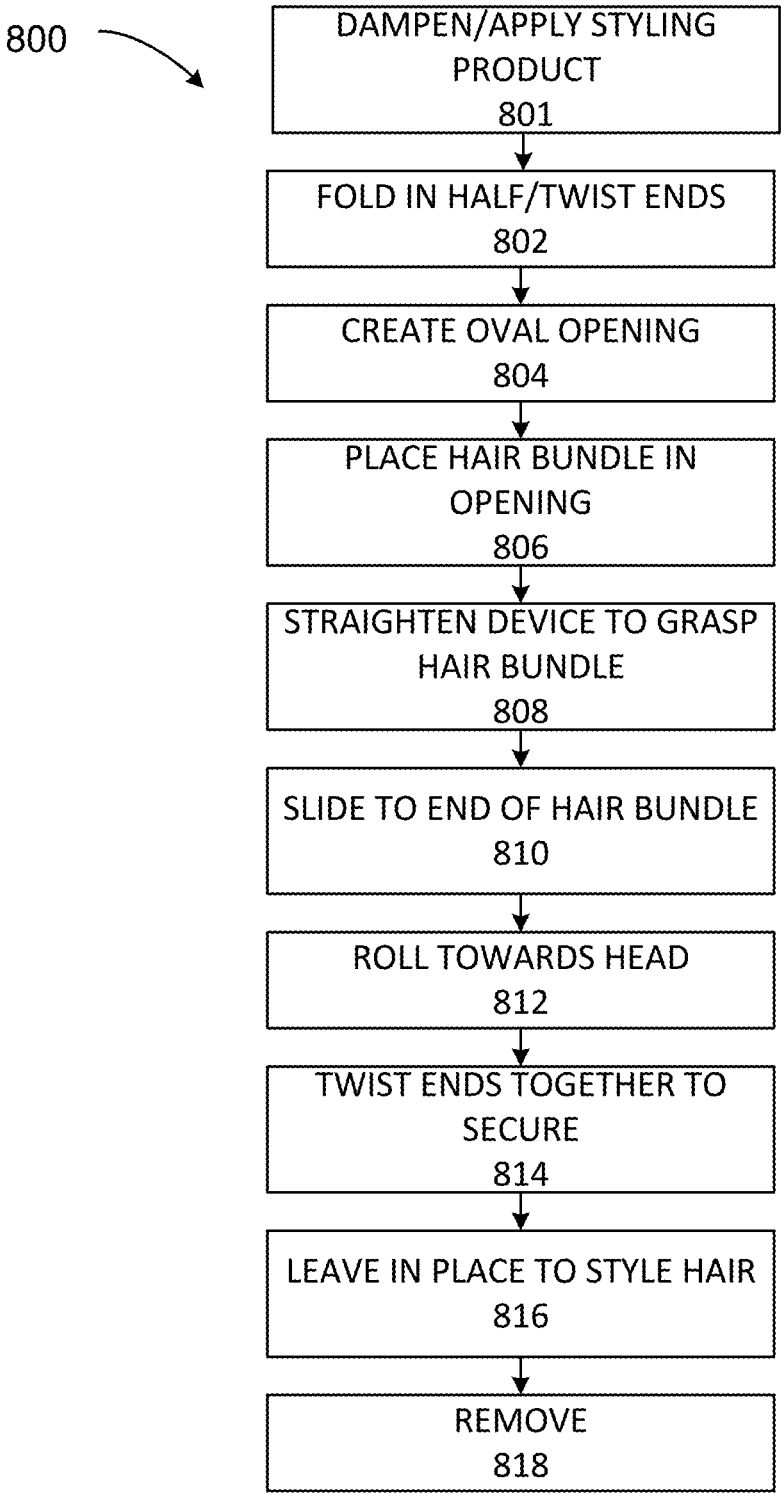
FIG. 8 is a block diagram illustrating a representative method of using a hair curling device such as disclosed herein.

FIG. 7C illustrates a fabric tube 720 comprising, in one example, a fabric piece 41.5 inches long by 3.5 inches wide, sewn to form a tube shape, and having at least one open end that can receive the wire/ring terminal assembly of FIGS. 7A-7B. The fabric tube 720 can be sealed with seams 722, 784, at least one of which is typically sewn after insertion of the wire/ring assembly. A seam along the length could be sewn after insertion of the wire/ring terminal assembly, but it is generally better to sew the length-wise seam first so that the fabric cover does not dent the hair when rolled, and use a tube end for insertion. FIG. 7D shows the wire/ring terminal assembly as inserted into the fabric tube 720 so that end portions of the fabric tube can be secured to the ring terminals 708, 710 with respective rivets or other fasteners, and an open end of the fabric tube sewn shut. As fixed to the wire/ring terminal assembly, the fabric tube 720 is gathered to be about 30 inches long so that a finished length is about 30 inches. If a loop shaped curling device is intended, both ends of the fabric tube and both ring terminals can be secured with a single rivet or other fastener. FIG. 7E is a sectional view illustrating the ring terminals 708, 710 secured to the fabric tube with a rivet 711.

As noted above, hair curling devices can have lengths between about 10 cm and 200 cm, 20 cm and 150 cm, 50 cm and 125 cm, or 75 cm and 110 cm, As a convenient example discussed above, a finished length of about 30 inches (about 75 cm) is selected. For looped shaped devices, similar circumferences are convenient.

In some examples, one or more wires are used as flexible members. Typically, multiple strands of solid copper wire are preferred as such wires do not tend to fatigue and break in use, and provide suitable stiffness for curling, and maintain shape for extended time periods to permit overnight styling. Surprisingly, copper bell wire is especially suitable, and materials such as aluminum do not provide sufficient stiffness to hold the hair for a sufficient time to allow curls to set. While various fabrics can be used, fabrics that provide some gripping of hair bundles are preferred, such as moleskin or suede. Other fabrics having a short pile on at least one surface can also provide superior curling results. Polyester fabric is preferred because it does not hold moisture like cotton, so that hair dries better to hold the curl. Fabric covers are formed so as to at least partially encase a flexible member and are sufficiently longer (and wider) than the flexible member so as to provide gathers than hold hair in place during curling.

A method of using of a hair curling device as disclosed herein includes optionally dampening hair or applying a styling product at 801. At 802, the curling device is folded in half and a loop is formed at 804. (For loop shaped devices, these steps are unnecessary). A hair bundle is situated in the opening at 806. At 808, the curling device is straightened (by, for example, pulling opposite sides of the loop), and the curling device is moved toward the ends of the hair bundle (if needed) at 810. The hair bundle is rolled onto the curling device at 812. When rolling is complete, ends of the curling device (or opposite sides of a loop) are twisted together at 814 to secure. The curling device is left in place for a suitable time period at 816, and removed at 818. Typically, styled hair is combed and/or shaken out after removal of the curling device.

Figure 9A:
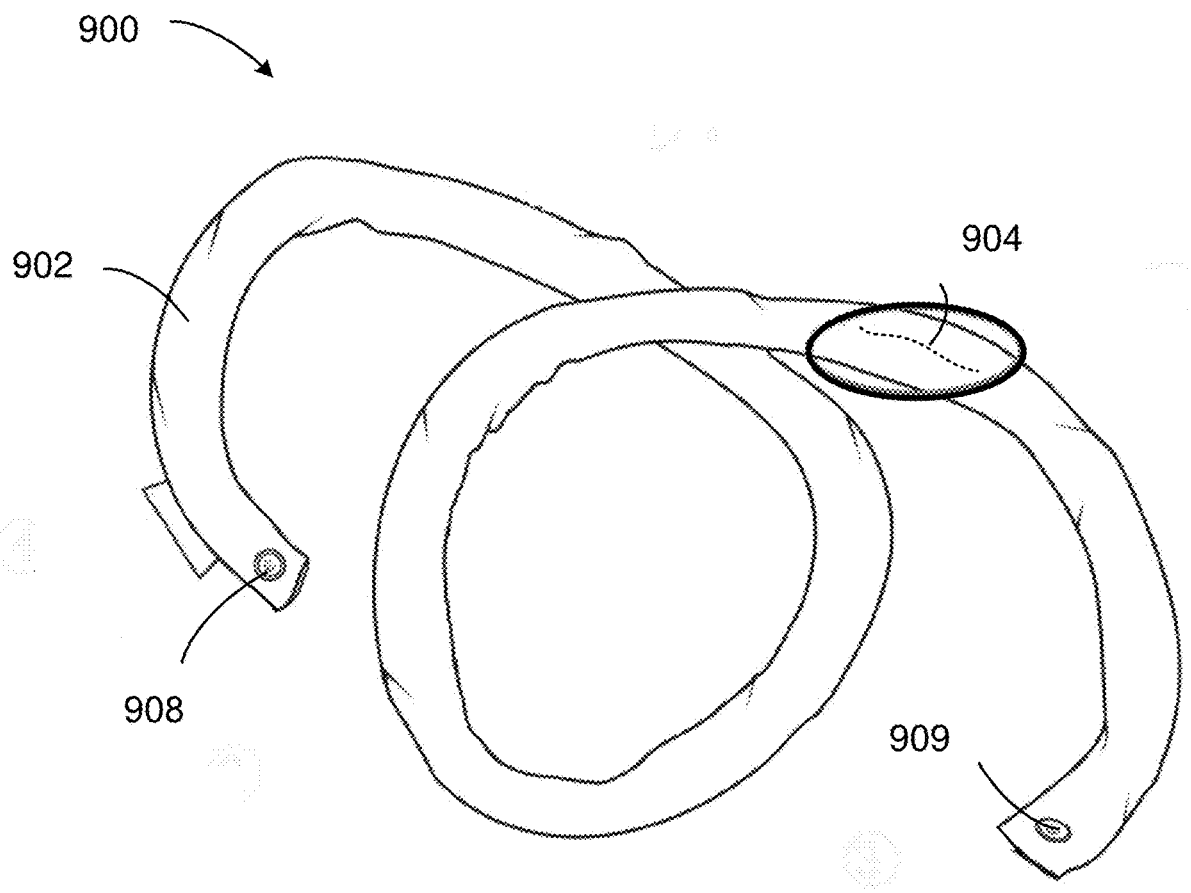
FIGS. 9A-9B illustrate another representative example of a hair curling device that can be bent or twisted to form one or more loops. The example of FIGS. 9A-9B is shown in proportion.
Figure 9B:
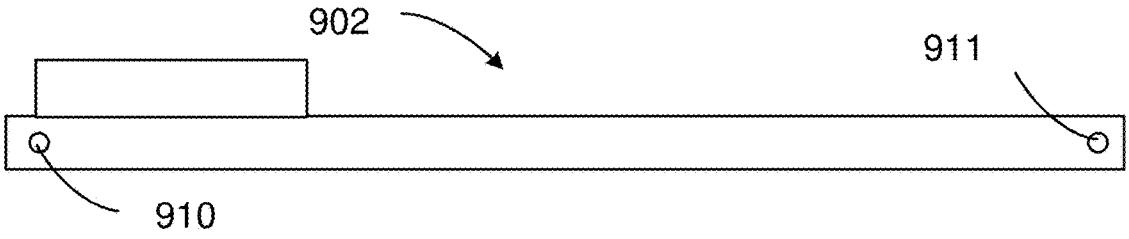

With reference to FIGS. 9A-9B, a representative hair curling device 900 includes a fabric tube 902 situated about a multi-wire cable 904 (shown in a partial cut-away of the fabric tube 902) with ring terminals crimped to cable ends. Snaps 908, 909 capture ends of the fabric tube 902 and the ring terminals to secure the multi-wire cable 904 to the fabric tube 902. As shown in FIG. 9B, holes 910, 911 are defined in the fabric tube 902 for insertion of the snaps 908, 909.

As noted above, a loosely fitted cover or tube permits the fabric cover to be gathered to engage hair bundles for curling and various lengths can be used. Fabric widths or fabric tube diameters are typically 2, 3, 5, or more times larger than a transverse dimension of a flexible support member. In addition, while 18-3 copper bell wire cable is convenient, other wire gauges and numbers of wires in a cable can be used, with suitable gauges ranging between 14 gauge and 20 gauge and numbers of conductors ranging from 1 to 20. Solid copper wires are preferred to provide suitable stiffness and durability. As described above, support members or cores can be fully enclosed in a fabric cover, or extend beyond a fabric cover at one or both ends. Flexible cores and the materials used in their fabrication must be of a suitable weight, flexibility, and stiffness so as to maintain hair shape during curling and thus resist unbending caused by the weight of the hair and movements of the wearer. Fasteners such as rivets, snaps, or screws can be used, or stitching can be used to secure a fabric cover and a flexible core. Various materials can be used for a fabric cover but should provide resistance to hair movement so that hair is retained in position during curling.

In view of the many possible embodiments to which the principles of the disclosure may be applied, it should be recognized that the illustrated embodiments are only preferred examples and should not be taken as limiting the scope of the invention. Rather, the scope of the invention is defined by the following claims. I therefore claim as my invention all that comes within the scope and spirit of these claims.

We claim:

1. A hair curling device, comprising:

an elongated flexible core;

a gathered fabric cover enclosing and extending along the elongated flexible core and secured to the elongated flexible core, wherein the elongated flexible core includes a plurality of 18-3 copper bell wires, and a length of fabric defining the gathered fabric cover is at least ⅓ larger than a length of the elongated flexible core; a ring terminal wire connector situated on each opposing end of the plurality of wires; wherein the ring terminals and end portions of the gathered fabric cover are secured together at a common location with a fastener thereby forming the device in a loop.

2. The hair curling device of claim 1, wherein the fabric cover encloses end portions of the elongated flexible core.

3. The hair curling device of claim 1, wherein the length of the fabric defining the gathered fabric cover is between 75 cm and 125 cm and the length of the elongated flexible core is between 50 cm and 100 cm.

4. The hair curling device of claim 1, wherein the fastener is a rivet or a snap or is sewn.

5. The hair curling device of claim 1, wherein the fastener secures the ring terminals to each other.

6. The hair curling device of claim 5, wherein the fastener is a rivet, snap or sewn.

7. The hair curling device of claim 1, wherein the gathered fabric cover is moleskin, suede, or polyester.

* * * * *